US005875960A

United States Patent [19]

Nanno

[11] Patent Number: 5,875,960

[45] **Date of Patent: *Mar. 2, 1999**

[54] PAPERBOARD CARTON FOR GRANULAR DETERGENTS

[75] Inventor: Yukio Nanno, Higashinada-ku, Japan

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 532,735

[22] PCT Filed: Apr. 5, 1994

[86] PCT No.: PCT/JP94/00564

§ 371 Date: Jul. 30, 1996

§ 102(e) Date: Jul. 30, 1996

[87] PCT Pub. No.: WO94/22725

PCT Pub. Date: Oct. 13, 1994

[30] Foreign Application Priority Data

Apr. 5, 1993 [JP] Japan ..... 5-016724

[51] Int. Cl.[6] ..... B65D 5/42

[52] U.S. Cl. ..... 229/146; 229/160.1

[58] Field of Search ..... 229/123, 146, 229/160.1

[56] References Cited

U.S. PATENT DOCUMENTS

| | | | |
|---|---|---|---|
| 3,171,600 | 3/1965 | Michalka | 229/146 |
| 3,486,682 | 12/1969 | Mahon et al. | 229/160.1 |
| 4,215,810 | 8/1980 | Zicko | 229/146 |
| 4,266,713 | 5/1981 | Maroszek | 229/146 |
| 5,476,218 | 12/1995 | Reisman | 229/123 |

FOREIGN PATENT DOCUMENTS

| | | | |
|---|---|---|---|
| 2444858 | 4/1975 | Germany | 229/160.1 |

*Primary Examiner*—Gary E. Elkins
*Attorney, Agent, or Firm*—Elizabeth M. Koch

[57] ABSTRACT

A paperboard carton providing improved dispensing of a granular detergent, the carton having a box having a back panel and a front panel, and having a top opening, and a lid integrally attached to the back panel along a first score line. The carton has at least one additional score line parallel to and spaced apart from the first score line and a slit substantially through the back panel at each side edge of the back panel from the first score line to the additional score line.

3 Claims, 4 Drawing Sheets

PAPERBOARD CARTON FOR GRANULAR DETERGENTS

FIELD OF THE INVENTION

The present invention relates to paperboard cartons for packaging granular detergent products. The invention is further related to such cartons which are have a re-closable lid, and which lid opens fully and remains open fully without springing on its own back toward the closed position, which permits easier dispensing of the granular detergent product from the carton.

BACKGROUND OF THE INVENTION

Many products are provided to consumers in granular form, such as detergent granules or powders. Such products are generally used in large volumes, so there is substantial interest and benefit in making cartons for such granular detergents from paperboard or other renewable and less expensive material. All-paperboard cartons for packaging and dispensing detergent granules are known, and include the tear-tape, side fill paperboard carton of Japanese Patent Application H3-506106, filed Mar. 1, 1991 in the name of Procter & Gamble Company, and the re-fill carton of Japanese Utility Model Application H3-063669, filed Aug. 12, 1991, in the name jointly of Dai Nippon Printing and Procter & Gamble Far East Inc. Nonetheless, such cartons are not completely satisfactory, and there remains a need for further improvements in the closing of and the dispensing from such cartons.

SUMMARY OF THE INVENTION

The present invention provides a paperboard carton for packaging and dispensing granular detergent comprising a box comprising a back panel and a front panel, and having a top opening, and a lid integrally attached to the back panel along a first score line. The carton is characterized wherein the back panel comprises at least one additional score line parallel to and spaced apart from the first score line, and a slit substantially through the back panel at each side edge of the back panel from the first score line to the additional score line. Preferably, the spaced apart distance is from about 5 mm to about 15 mm, preferably about 10 mm; preferably the slit from the first score line to the second score line is along a diagonal line forming an angle with vertical from about 15° to about 60°, preferably about 30°–45°; and preferably the slit is made completely through the thickness of the paperboard.

The carton can have other optional features found commonly in conventional paperboard cartons, such as one or more lines of weakness across one or more panels of the carton to facilitate collapsing of the carton after the product is completely used up, for compact and easy disposal. Also, tear strips, which are well-known in the art, can be employed.

DETAILED DESCRIPTION OF THE INVENTION

Figure 1:
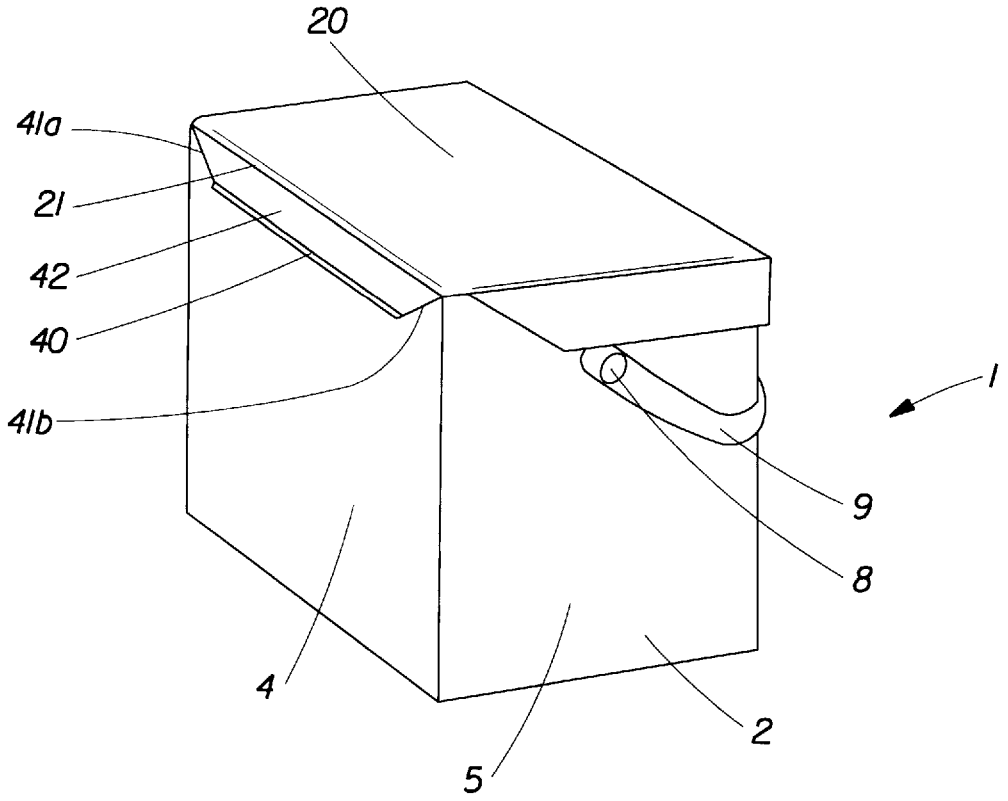
FIG. 1 shows a perspective view of the back and left side panels of a paperboard carton with the lid in the closed position.
Figure 2:
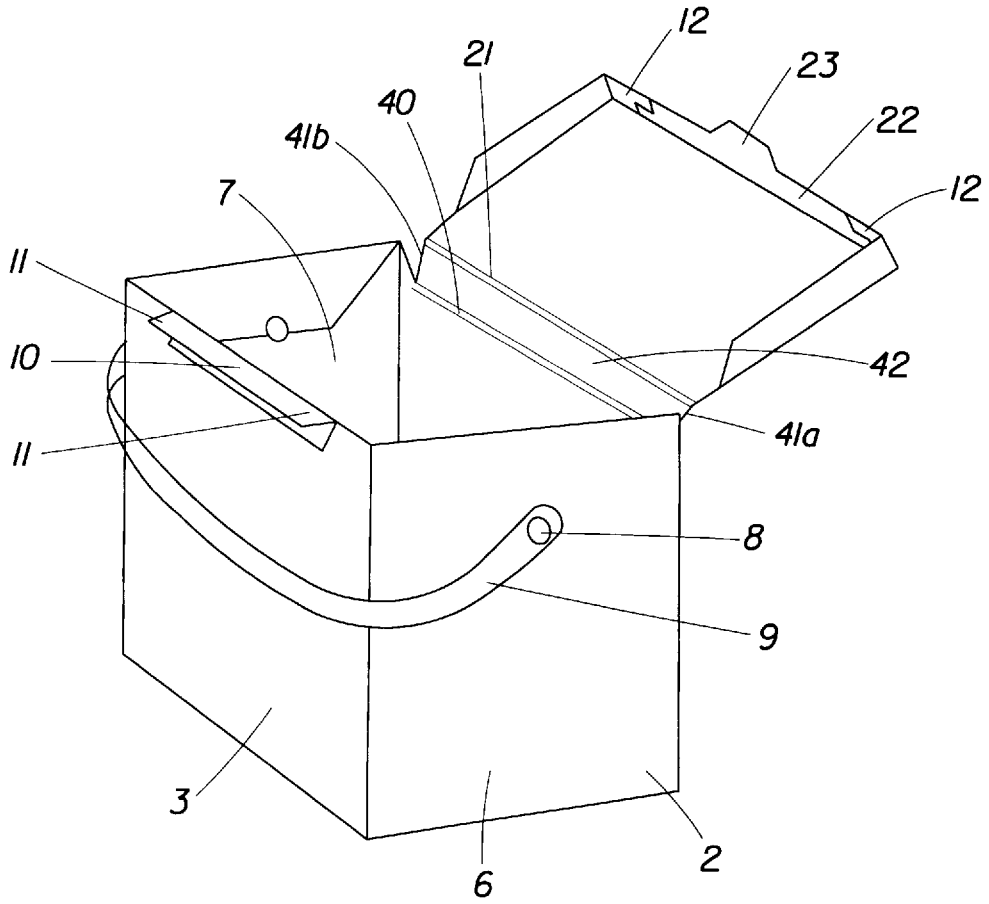
FIG. 2 shows a perspective view of the front and right side panels of a paperboard carton with the lid in the open position.

FIG. 1 and FIG. 2 show a carton 1 with a box 2 and a lid 20. The box has a front panel 3, a back panel 4, and side panels 5 and 6. The box has a top opening 7 as shown in FIG. 2. The box 2 of the carton is folded and sealed in such a way to prevent the flow of granular detergent out of the enclosed box prior to opening so as not to lose any granular detergent product and create a mess.

The lid 20 is integrally attached to the back panel along a first score line 21. The back panel 4 also has at least one additional score line 40 which is parallel to and spaced apart from the first score line 21, and two slits 41*a*, 41*b* substantially through the back panel 4 at each side edge of the back panel, from the first score line 21 to the additional score line 40. The slits are cut very fine to prevent any leakage of granular detergent through the fine slit when the lid is in the closed position over the opening 7.

A suitable type of paperboard is that referred to in the art as clay coated newsprint. It is preferred that the paperboard be given a barrier coating or can be laminated with various thermoplastics to make it moisture impervious.

When the carton is first opened, the consumer lifts up on tab 23 of flap 22 of the lid, thereby breaking an adhesive securing means (not shown), such as with hot-melt adhesive, between the inside surface of the flap 22 and the outside-facing surface of the front panel 3. As the lid 20 is raised, it pivots at a first hinge defined by score line 21.

As the consumer continues to pull back the lid, portion 42 of the back panel 4 also begins to fold backward and pivot at a second hinge defined by additional score line 40. Two or more additional score lines can be employed. To permit the portion 42 to fold back freely, slits 41*a*, 41*b* are made along the side edges of portion 42, running from score line 21 to additional score line 40. Preferably the slit 41 is made substantially, though not completely, through the paperboard, so as to prevent any powder spillage during manufacturing and shipping, but also to enable the slit to separate fully when the lid is first pulled back.

A handy carrying strap 9, typically made of a thermoplastic material, can be pivotally secured to the sides 5 and 6 of the carton using rivets 8 which are secured through the side panel paperboard.

A carton 1 can also comprise a means for securing the lid to the box after a portion of the detergent granules have been dispensed. In a preferred embodiment shown in FIG. 2, a flap 10 extends down and outward from the top edge of the front panel 3. When the lid is in the closed position as shown in FIG. 1, ends 11 of the flap 10 engage ears 12 located inside of flap 22. The engagement of the ends 11 with the ears 12 is sufficient to keep the lid securely closed under ordinary storage conditions, but can be overcome by the user when lifting again on the lid to open the carton. In a most preferred embodiment, the flap 10 is stamped out of the paperboard of front panel 4 as shown in FIG. 3, while flap 14 is folded inward and secured to the inside of front panel 4 to provide support; it is important that flap 14 not be secured to flap 10 to ensure that flap 10 can pivot and move independent from front panel 4.

In order to minimize the opportunity for undesirable spillage of product from the top openings of the carton, it is most preferable to fill the carton with detergent granules no higher than the additional score line 40.

Figure 3:
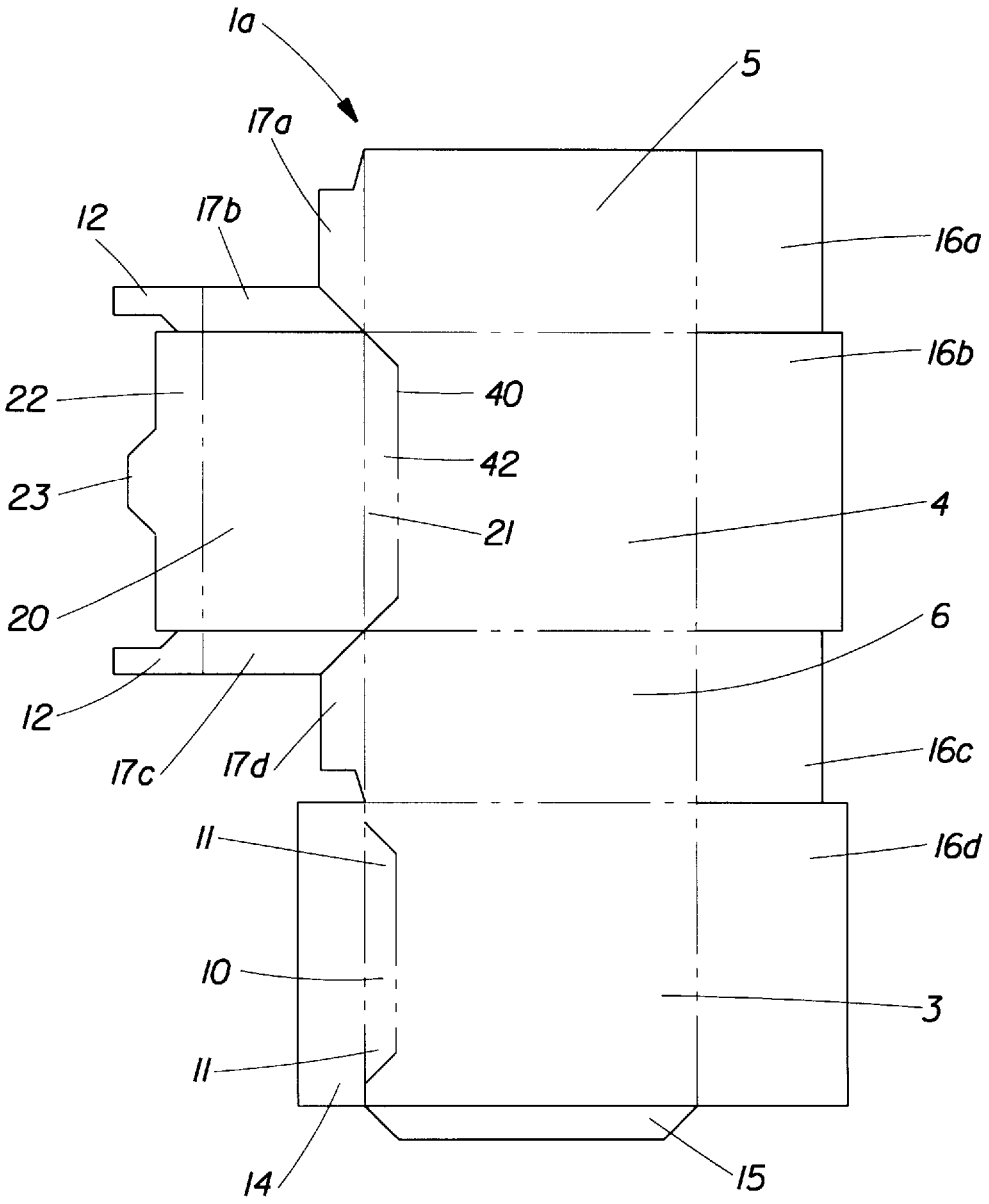
FIG. 3 shows a plan view of the blank used to make a carton of the present invention.

It is preferred that the carton 1 be made from a single blank 1*a* of paperboard as shown in FIG. 3. Blank 1*a* shows double-lined score lines in the paperboard to provide folding and pivoting of the adjacent paperboard surfaces. Axial score lines form the boundaries between panels 3, 4, 5, 6, and 15. Glue flap 15 is designed to be wrapped around and adhered, preferably by hot melt adhesive, to side wall 5.

Transverse score lines form the boundaries between panels 5 and 6, and flaps 16*a,* 16*c* and 17*a,* 17*c,* and between panels 3 and 4, and bottom flaps 16*b,* 16*d.* Bottom flaps 16 can be folded inward and secured to form the bottom of the box. Flaps 17 and ears 12 are preferably first folded inward and secured; then flap 22 is folded inward and secured to ears 12, thereby forming lid 2.

Preferably, the box 2 also comprises an inserted liner (not shown) to reduce leakage of granular detergent product. The liner has four panels responding in lateral dimension to the inside of each side, front, and back panel of the box. The liner is positioned inside the carton to extend to the top opening 7.

A preferred method of filling the container is to fold and seal all panels, leaving the bottom panels 16 to be sealed last after the detergent granules are filled into the carton from the bottom.

Figure 4:
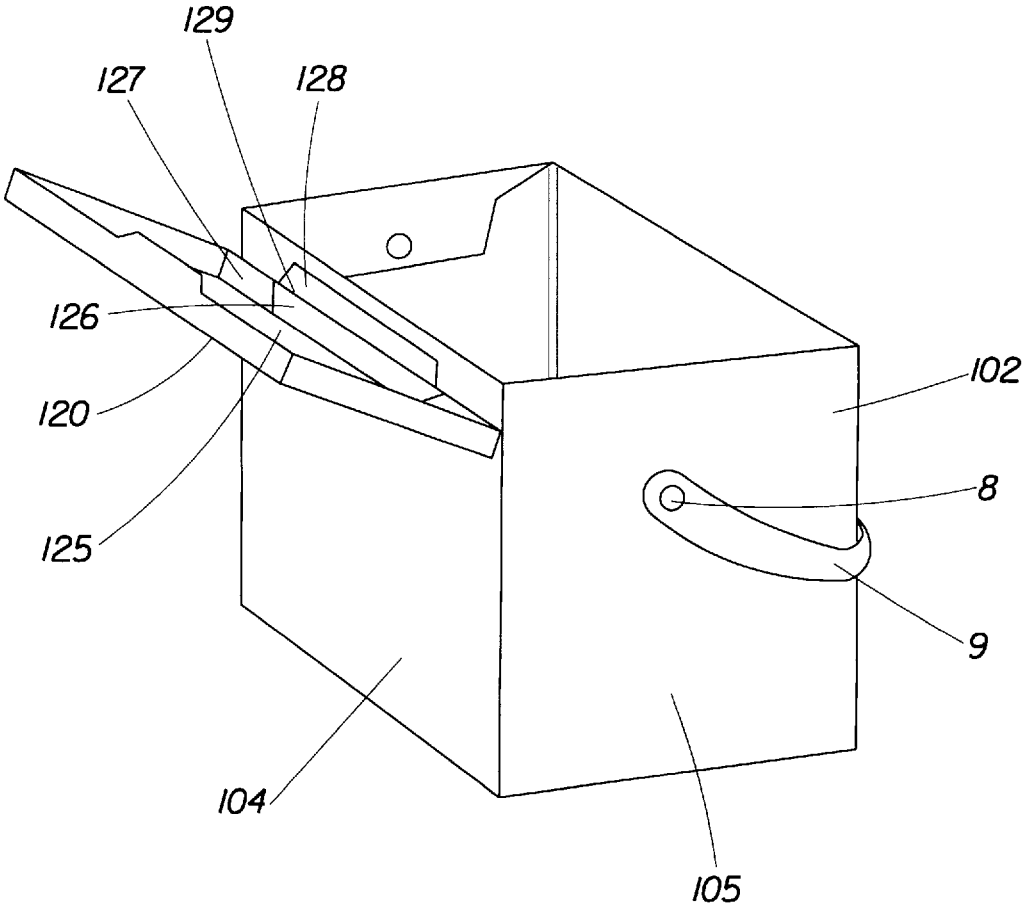
FIG. 4 shows another embodiment of a paperboard carton with a reclosable lid.

FIG. 4 shows another embodiment of a re-closable, all-paperboard carton. The carton comprises a box 101 and a hinged lid 120. The box 101 comprises a back panel 104 and has a top opening 107. The hinged lid 120 is attached to the back panel. The lid comprises a top portion 125 and a back portion 126 comprising a first panel 127 extending from the top portion 125 and a second panel 128 extending from the first panel 127 along a score line 129. The second panel 128 has an outer-facing surface and an inner-facing surface, wherein at least a portion of the outer-facing surface of the second panel is attached to the back panel 104 of the box, whereby the score line 129 forms a hinge for the lid.

We claim:

1. A paperboard carton for packaging and dispensing granular detergent, comprising:

a box comprising a back panel and a front panel, and having a top opening; and a lid having a top surface, said top surface integrally attached to said back panel along a first score line, said first score line defining an edge of said top surface, wherein said back panel comprises:

at least one additional score line parallel to and spaced apart from said first score line, each of said score lines forming a hinge; and a slit substantially through said back panel at each side edge of said back panel from said first score line to said at least one additional score line.

2. The carton of claim 1, wherein said spaced apart distance is from about 5 mm to about 15 mm.

3. The carton of claim 2, wherein said slit from said first score line to said second score line is along a diagonal line forming an angle with vertical from about 15° to about 60°.

* * * * *